US006024310A

United States Patent [19]

Herdman

[11] Patent Number: 6,024,310

[45] **Date of Patent: *Feb. 15, 2000**

[54] SANDWICH DESIGN CRUSHING/ SHREDDING MACHINE

[75] Inventor: James Herdman, Chatham, N.J.

[73] Assignee: Atlantic Coast Crushers, Inc., Kenilworth, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,273

[22] Filed: Nov. 4, 1997

[51] Int. Cl.[7] ..... B02C 13/06

[52] U.S. Cl. ..... 241/46.08; 241/46.06; 241/89.4

[58] Field of Search ..... 241/89.4, 46.02, 241/46.06, 46.08, 101.1

[56] References Cited

U.S. PATENT DOCUMENTS

| | | | |
|---|---|---|---|
| 2,001,075 | 5/1935 | Sundstrand | 146/123 |
| 2,280,211 | 4/1942 | Bernhardt | 146/123 |
| 3,313,331 | 4/1967 | DiPierro et al. | 146/123 |
| 3,357,468 | 12/1967 | Brinch-Moller | 146/123 |
| 3,439,361 | 4/1969 | Moore | 4/10 |
| 3,527,277 | 9/1970 | Woods | 146/123 |
| 4,457,490 | 7/1984 | Scobie | 251/174 |
| 5,186,401 | 2/1993 | Herdmn et al. | 241/46.01 |

*Primary Examiner*—Joseph J. Hail, III
*Assistant Examiner*—William Hong
*Attorney, Agent, or Firm*—Richard R. Muccino

[57] ABSTRACT

The present invention is directed to a sandwich design crushing/shredding machine. The machine comprises a stationary grid and a rotatable set of blades on a shaft. The stationary grid is adapted for connection into a flow line, has a first flange and a second flange, and an attachment means attaching the first flange to the second flange in face-to-face relationship. The first flange has an open inner portion. The second flange has a grid inner portion of the same general shape as the open inner portion of the first flange, and a number of parallel grid openings. The attached first and second flanges have a bore extending diametrically through the flanges. A rotatable set of blades on a shaft extends axially through the bore, and is adapted for rotation by an exterior power source. Each blade corresponds to a grid opening and is positioned along the shaft within its grid opening. The present invention also includes a method for making the sandwich design crushing/shredding machine and the sandwich design crushing/shredding machine prepared by the novel method.

2 Claims, 2 Drawing Sheets

Figure 1
Figure 1A
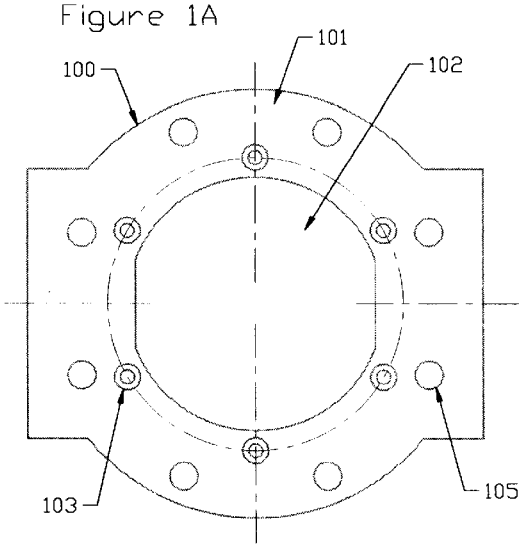
Figure 1B
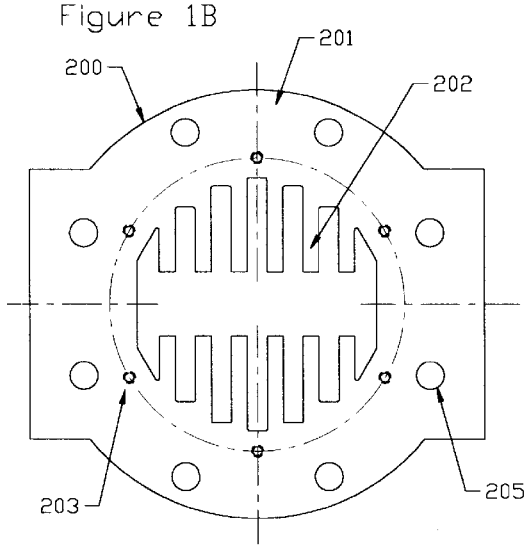
Figure 1C
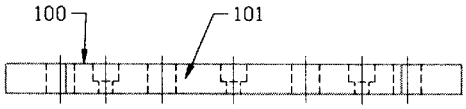
Figure 1D
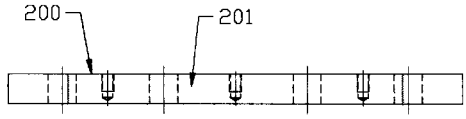
Figure 1E
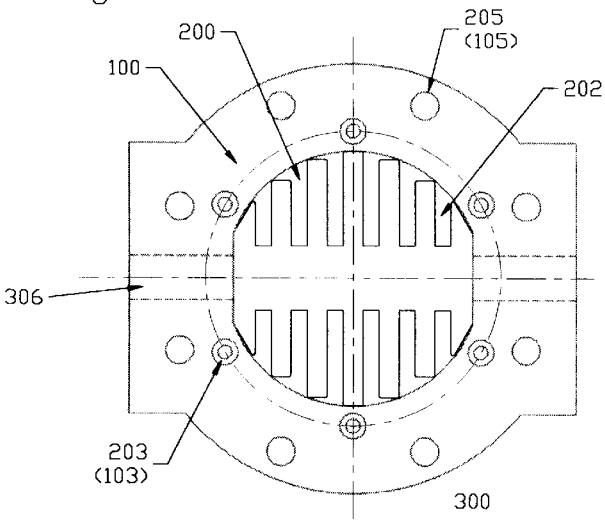
Figure 1F
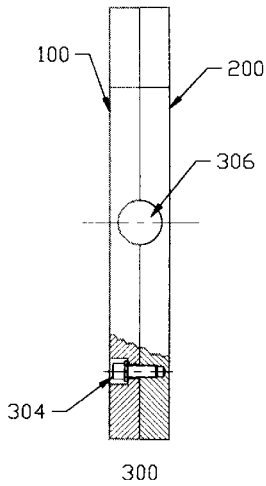

Figure 2
Figure 2A
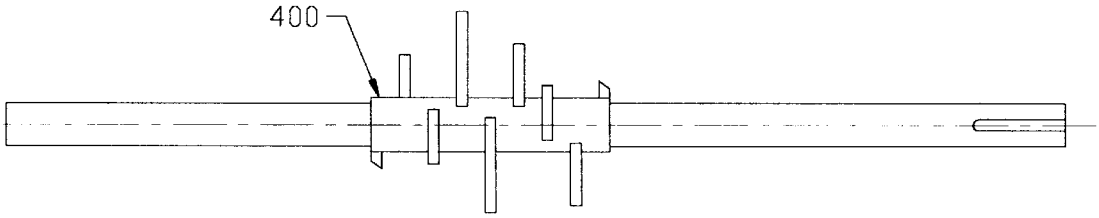
Figure 2B
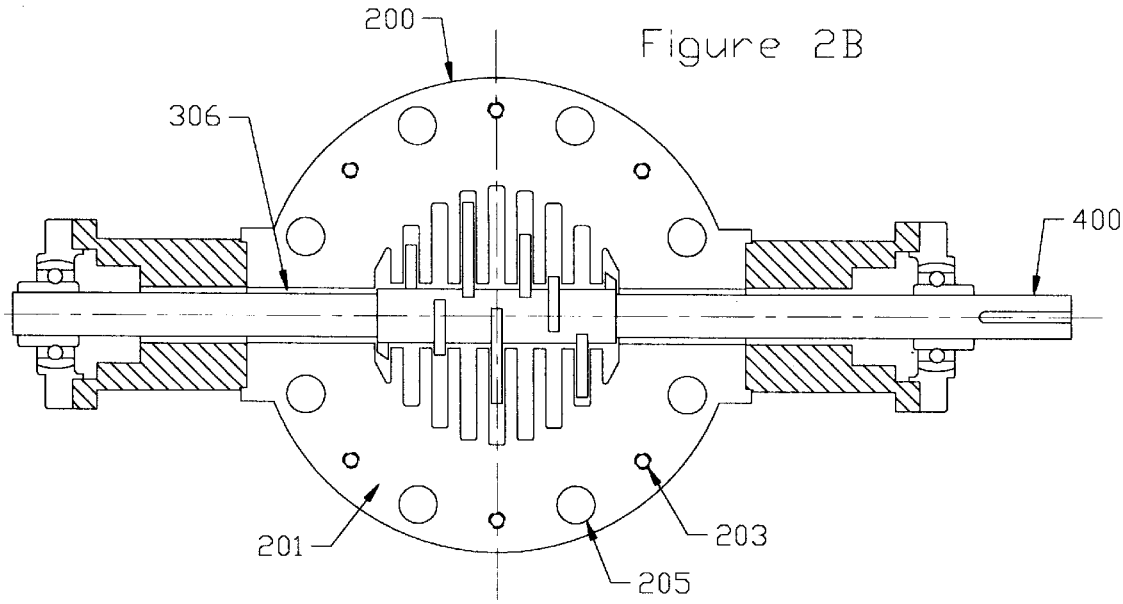
Figure 2C
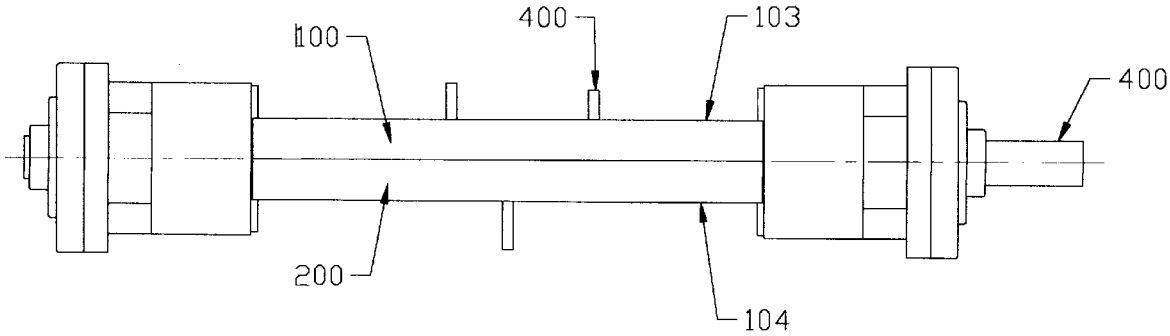

SANDWICH DESIGN CRUSHING/ SHREDDING MACHINE

FIELD OF THE INVENTION

The present invention is directed to a novel sandwich design crushing/shredding machine. The machine comprises a stationary grid and a rotatable set of blades on a shaft. The stationary grid is adapted for connection into a flow line, has a first flange and a second flange, and an attachment means attaching the first flange to the second flange in face-to-face relationship. The first flange has an open inner portion. The second flange has a grid inner portion of the same general shape as the open inner portion of the first flange, and a number of parallel grid openings. The attached first and second flanges have a bore extending diametrically through the flanges. A rotatable set of blades on a shaft extends axially through the bore, and is adapted for rotation by an exterior power source. Each blade corresponds to a grid opening and is positioned along the shaft within its grid opening. The present invention also includes a method for making the novel sandwich design crushing/shredding machine and the sandwich design crushing/shredding machine prepared by the novel method.

DESCRIPTION OF THE BACKGROUND

The manufacture of many materials requires the use of size reduction equipment to make the subsequent transport and reaction processes efficient and cost effective. Oversize solids can obstruct pipe or conveyor systems and larger particles take more time to react during chemical processes. Industrial crushing and shredding machines are used in the process industries to break up oversize materials and reduce them to a consistent and free flowing size. There is considerable efficiency savings to be realized by crushing or shredding oversize materials to a smaller size.

The design for most crushing and shredding machines generally involves arranging a rotating set of blades to intermesh with a stationary screen, bar, or grid. The stationary screen generally has a dual purpose to retain material in the crushing zone and to act as an impact surface as the rotating blade passes by. These cutting, breaking, or shredding designs are well established. However the challenge has been to design an economical arrangement of the rotary blades and stationary girds within an enclosed body or framework.

In industry, the body and the breaking system design of crushing and shredding machines often have to be designed to meet a variety of shapes and requirements. Many sizes are required. Openings can be round (pipe sizes), oval, square, or rectangular, depending upon the particular application. The system may require the body to be pressure tight or dust tight. Since many of these machines are installed in existing transport systems, it is often important that the machine be very compact, and that its inlet to outlet dimension be as small as possible.

Current methods for manufacturing the body of these crushing and shredding machines involve a considerable amount of pre-machining, welding, finish machining, and the use of numerous high precision parts. Generally this is caused by the need to enclose the rotary blade system within the body. In order to process materials efficiently, the blade swing diameter, the diameter that the tip of the blades travel during rotation, must be roughly equivalent to the size of the opening. The design problem has been to house this large rotating part in a structurally sound body which is capable of being sealed and holding pressure. These conflicting requirements have made typical crushing and shredding machines designs bulky and expensive.

U.S. Pat. No. 2,001,075 (Sundstrand) discloses a nut chopper comprising a jar 5 (see FIG. 1) which receives broken foodstuff from a crusher or breaker 6 attached to the lower end of a hopper 7. The breaker or comminuting means 6, provided in the bottom of hopper 7, consists of a grate plate 17 (see FIGS. 1–3) mounted in the hopper and slotted transversely to provide a number of equally spaced parallel grate bars 18, between which breaker prongs 19 on rotary blade 20 are arranged to operate. The plate 17 is bent to a V cross-section (see FIG. 2) so that the bars 18 form a crotch, and the prongs 19 on the blade 20 move through the crotch so that the material to be broken drops into the crotch in front of the teeth 19 and is broken by the movement of the prongs between the bars forming the crotch. For ease of operation, one radial prong 19 at a time is passed between the bars 18 instead of the entire set of prongs. The blade 20 is formed with a small axial prong 22 (see FIG. 4) at one end and a notch 23 at the other end. The prong 22 is arranged to be passed through hole 24 of large diameter provided in one side wall of hopper 7 where a bushing 25 is pressed onto the prong 22 to have a close working fit in the hole. A small plug 26, having an annular flange 27 on one end, is entered in the notch 23 far enough so that the end of the blade enters diametrically opposed slots 28 provided in the flange 27. Small projections 29 on the end of the blade are then used to fasten the plug in place.

U.S. Pat. No. 2,280,211 (Bernhardt) discloses a machine for chopping nut meats. The machine has a container 6 (see FIGS. 1–4) for receiving the chopped nut meats which is attached to a base or cylinder 8 fitted to a cylindrical hopper 12. The bottom 14 of the hopper has a number of parallel slots 15 forming intermediate cutting or chopping bars 16 which extend transversely across the bottom (FIG. 1). The cylinder 8 and the hopper 12 are provided respectively with diametrically opposed holes 17 and 18 which provide a bearing for a shaft or rod 19 which serves to hold the cylinder and hopper in position. One end of this shaft is bent to form a crank 20. A portion of the shaft 19 is ridged or knurled 22 for engagement with a sleeve 23. The ends of the sleeve are reduced or shouldered at 24 for receiving the chopping or breaking elements 25. Each of these elements consists of a disk or ring 26 which fit over the reduced ends of the sleeve. Each disk has three sets of oppositely disposed blades 27, 28 and 29. The blades 27 lie in the same plane as the rings 26 and are adapted to move downwardly through one of the slots 15 and coact with the adjacent bars. The blades 28 extend for a short distance substantially parallel to the shaft and then project outwardly in a plane parallel to the plane of the ring or so that they will engage with the next adjacent slots 15 toward the sides of the hopper (FIG. 1). The blades 29 also extend for a short distance substantially parallel to the shaft in a direction opposite from the blades 28 and then extend outwardly so that they will cooperate with the slots adjacent to the center of the hopper. The final assembly is made by holding the cutting cylinder with the teeth in position in the hopper by means of suitable holders and then inserting the shaft 19 through one set of holes and forcing it through the bore 30 of the sieve 23 which provides a tight fit between these parts. When assembled, some of the cutter blades will be projected through their co-operating slots and will engage with the adjacent bars to prevent more than a limited longitudinal movement of the shaft and parts connected therewith.

U.S. Pat. No. 2,648,365 (Lacout) discloses a chopping device for vegetable matter. The chopping device is provided with a comb manufactured in the handle Q (see FIGS. 1–4) formed by a trough or channel piece open at both ends, the edges of which are bent at right angles at 17. The container 18 or hopper is provided with side extensions 10 that shut off the end of the channelled piece in the working position (FIG. 3) and swing over the edges 17 of the comb by means of spindles 24. A medial opening 20 is arranged in each extension 19 of the container, the bottom 23 of which is bent at right angles outwardly acting as a bearing for the spindle M carrying the discs C1, C2 (FIG. 2), that rests on the solid portions of the comb. The edges 21 and 22 of these openings 20 assume the shape of cams or of converging curved sloping surfaces that ensure the automatic centering of the spindle M carrying the discs. The surface of the container nearest to the handle Q carries a spring blade 25 riveted at 26 and provided at its lower portion with an opening 21 intended to engage with a stud 29 formed inside an opening 28 provided in the handle. The spindle M of the crank-handle carries the discs C1, C2, that are arranged so that the crank-handle is located in the axial plane of symmetry corresponding to the toothed portions of the discs.

U.S. Pat. No. 3,357,468 (Brzinch-Moller) discloses a domestic chopping apparatus which comprises a base portion; a knife axle, having an axis, rotatably mounted in the base portion; a number of knives radially mounted on the knife axle; a grate positioned over, and in contact with, the knife axle, wherein the grate has edges supported by the base portion; and a number of slits extending transverse to the axis whereby the knives co-operate with the grate when the knife axle is rotated. A funnel portion is mounted on the base portion over the grate. The material to be chopped is placed in the funnel 1 (FIG. 1), falls down because of the conical shape of the funnel, is taken along by the turning of the knives, and is cut into pieces in the usual manner.

U.S. Pat. No. 3,439,361 (Moore) discloses a sewage comminuting device for use in combination with a toilet which includes a water supply and flush actuator and which provides a sewage outlet. The device comprises (a) a tubular frame having an inner wall defining a space with one end connected to the toilet sewage outlet and the opposite end providing a comminuted sewage outlet; (b) a bushing disposed perpendicular to the direction of flow through the tubular frame at a point intermediate its ends shaft rotatably held in the bushing; (c) a cutter blade secured for rotation with the shaft and being disposed inside of the tubular frame parallel to the direction of flow cutter bar disposed in the tubular frame and being secured therein in shearing relationship to the rotatable cutter blade; (d) a motor connected to provide rotational output to the shaft; and (e) and a means for periodically energizing the motor coincident with the flushing of the toilet. The comminuting device 14 with the cutting implements are shown in greater detail in FIGS. 2, 3, and 4. Shaft 44 is rotatably inserted through opposite sides of frame 28, bushing seatings 46 and 48, to carry a set of cutter blades 74, 76, 78, 80, 82, 84, and 86 for rotation in a spaced relationship. A first, upper set of cutter bars 88, 90, 92, 94, 96 and 98 are disposed in a spaced parallel relationship and each is rigidly secured about one side of an inner side wall 100 of tubular frame 28. Cutter bars 88–98 are placed equispaced between each adjacent pair of cutter blades 74–86. Similarly, a second, lower set of cutter bars 102, 104, 106, 108, 110 and 112 are secured about the opposite side of inner side wall 100 between adjacent ones of cutter blades 74–86, and each of cutter bars 102–112 is affixed in alignment with a symmetrical counterpart of the group of cutter bars 88–98. The lower cutter bars 102–112 are affixed in opposite orientation from upper cutter bars 88–98. A set of spacers 114, 116, 118, 120, 122, and 124 are placed about the rotational drive shaft between respective adjacent ones of cutter blades 74–86 to provide their proper spacing with respect to the stationary cutter bars 88–98 and 102–112 while assuring sufficient but minimal clearance space between the intersticed cutting components. As shown in FIG. 3, each of the cutter blades 80–86 has a similarly oriented square hole 130 through its center through which is received a square central portion 44*a* of the rotational drive shaft 44. The fiber spacers such as spacer 118 are then slipped over the shaft portion 44*a*. Each side of the respective cutter blades 80–86 has a claw-like shape wherein the leading edge is tapered rotationally forward toward its more outward extent. Thus, cutter blade 80 has its rotational leading edges shaped into points 132 and 134, cutter blade 82 has points 136 and 138, cutter blade 84 has points 140 and 142, and cutter blade 86 has points 144 and 146 formed on its respective leading edges. The upper cutter bars 102–112 are each shaped to have a similar right triangular configuration, and are disposed with their respective bases 150 horizontal and perpendicularly aligned with shaft 44 and with their respective adjacent sides 152 welded or otherwise securely fastened to inner side wall 100 of tubular frame 28.

U.S. Pat. No. 3,527,277 (Woods) discloses a nut meat chopping device comprising a hopper having a cylindrical lower portion. A support for the hopper has a cylindrical portion telescoping on the lower cylindrical portion of the hopper. An undulated slotted plate is disposed horizontally transversely in the lower cylindrical portion of the hopper. A rotary elongated toothed cutter-bar is disposed horizontally below the plate with the teeth arranged to extend through the slots in the plate to chop material coming between the teeth and plate. A rotary shaft is affixed to the cutter-bar. The improvement consists in providing the telescoping portions of the hopper and support and providing an undulated bead inside the cylindrical portion of the hopper to engage the top of the undulated slotted plate about its peripheral portion to prevent its upward displacement and hold the plate against turning in the hopper. The lower portion of the hopper has vertical slots provided in diametrically opposite sides in which the shaft is rotatably received at opposite ends for bearing support of the shaft and cutter-bar assembly. The cutter-bar is curved diametrically to conform on its one side to the inside curvature of the diametrical portion of the slotted plate and conform on its other side to the shaft to which it is secured. Two spacer washers on the shaft abut opposite ends of the cutter-bar to engage the sides of the cylindrical lower portion of the hopper and maintain the teeth of the cutter-bar in relationship to the slots in the undulated plate. The spacer washers serve to limit end-play of the shaft and cutter-bar while the undulated bead locates the slotted plate in a predetermined operative relationship to the shaft and cutter-bar. The slotted plate is held against downward displacement from operative position by the shaft. The slotted plate is in a limited floating relation to the bead and cutter-bar to allow shifting of the interengaging cutter-bar and slotted plate to avoid clashing.

U.S. Pat. No. 3,907,215 (Mantelet) discloses a manually operated food chopper comprising a shaft having a series of chopper blades. A plastic cradle is provided in which the shaft is supported for rotation about a horizontal axis. A spring steel slotted plate is retained in the cradle below the shaft and is of a generally U-shaped configuration having two legs at the ends of which means are disposed which resiliently engage with opposite side walls of the cradle. A plastic hopper is mounted for vertical swinging movement on the cradle between an upright position in which the hopper feeds downwardly into the cradle and retains the shaft in the cradle and a downwardly swung position in which the hopper releases the shaft. A leaf spring is secured at one end to the hopper for releasably retaining the hopper on the cradle in the upright position.

U.S. Pat. No. 4,491,278 (Galanty) discloses an improved comminutor device for a sewage system. The device comprises a one piece hemispherical cup-like cage forming a concave surface traversely disposed in a sewage system along a flow path of the system. The cage has a set of slotted openings cutting the cage in planes perpendicular to an axis and the slotted openings are formed by a set of spaced-apart arcuate elements along the concave cup-like surface and extending toward a down-stream side of the flow path of the system. The cage has a stationary circular section with spaced-apart cutter and shredding teeth formed along a peripheral edge. Each of the teeth is disposed in alignment with a corresponding end of the arcuate elements of the cage and has individual dimensions along the axis and path of flow which are greater than that of the arcuate elements of the cage. A one piece rotatable member has a set of cutting and shredding teeth formed on at least two C-shaped diametrically opposed members rotatably mounted co-axially with the cup-like cage and disposed perpendicular to the flow of sewage on an up-stream side of the flow path. The set of teeth on each of the C-shaped rotatable members extends for interengagement with the circular section of spaced-apart cutter and shredding teeth of the cage and for intermeshing with the arcuate elements of the cage. A driving means is provided for rotating the rotatably mounted C-shaped diametrically opposed members about the axis of the cage for interengaging the teeth of the circular section and for sweeping through the set of slotted openings of the cage.

U.S. Pat. No. 5,186,401 (Herdman) discloses a crushing machine. The crushing machine comprises (a) a housing comprising a "T"-shaped hollow body having two conduit ends adapted for connection into a flow line and having a bore end; (b) the hollow body defining a cartridge bore fully intersecting the flow path between the conduit ends and terminating in the bore end; (c) a crushing cartridge independent of the cartridge bore. The crushing cartridge extends axially through the cartridge bore, through the bore 35 end and is adapted for rotation by an external power source. The crushing cartridge is removable from and installable into the housing as a single, integral unit and is serviceable and adjustable independently of the housing. The crushing machine also includes attachment means to attach the crushing cartridge to the housing at the bore end.

IN THE FIGURES

FIG. 1 illustrates diagrammatic views of the different components of the crushing/shredding machine in a preferred embodiment.

FIG. 1A is a front view of the first flange having an open inner portion of the stationary grid of the crushing/shredding machine.

FIG. 1B is a front view of the second flange having a grid inner portion of the stationary grid of the crushing/shredding machine.

FIG. 1C is a top view of the first flange of the stationary grid of the crushing/shredding machine showing the thickness of the flange.

FIG. 1D is a top view of the second flange of the stationary grid of the crushing/shredding machine showing the thickness of the flange.

FIG. 1E is a front view of the stationary grid with the first flange attached to the second flange.

FIG. 1F is a side view of the stationary grid with the first flange attached to the second flange showing a bore extending diametrically through the attached first and second flanges at the seam where the flanges are attached.

FIG. 2 illustrates diagrammatic views of the different components of the crushing/shredding machine in a preferred embodiment.

FIG. 2A is a front view of a rotatable set of blades on a shaft.

FIG. 2B is a front cross sectional view of the assembled crushing/shredding machine with the rotatable set of blades on a shaft extending axially through a bore.

FIG. 2C is a top view of the assembled crushing/shredding machine with the rotatable set of blades on a shaft extending axially through a bore.

SUMMARY OF THE INVENTION

The present invention is directed to a crushing/shredding machine which comprises:

(a) a stationary grid, adapted for connection into a flow line, having a first flange and a second flange, and an attachment means attaching the first flange to the second flange in face-to-face relationship, wherein:
  (i) the first flange has an open inner portion;
  (ii) the second flange has a grid inner portion of the same general shape as the open inner portion of the first flange, and wherein the grid inner portion has a number of parallel grid openings; and
  (iii) the attached first and second flanges have a bore extending diametrically through the attached first and second flanges; and (b) a rotatable set of blades on a shaft extending axially through the bore, and adapted for rotation by an exterior power source, each blade corresponding to a grid opening, and positioned along the shaft within its grid opening.

In another embodiment, the invention is directed to a method for making a crushing/shredding machine having a stationary grid and a rotatable set of blades on a shaft which comprises the steps of:

(a) providing a first flange and a second flange, wherein the first flange has an open inner portion and the second flange has a grid inner portion of the same general shape as the open inner portion of the first flange, and wherein the grid inner portion has a number of parallel grid openings;

(b) providing an attachment means for attaching the first flange to the second flange in face-to-face relationship;

(c) attaching the first flange to the second flange in face-to-face relationship to form the stationary grid;

(d) boring a hole extending diametrically through the attached first and second flanges;

(e) detaching the first and second flanges;

(f) inserting a rotatable set of blades on a shaft axially through the bored hole, wherein the rotatable set of blades is adapted for rotation by an exterior power source, and each blade corresponds to a grid opening, and is positioned along the shaft within its grid opening; and (g) attaching the first flange to the second flange, with the rotatable set of blades on a shaft extending axially through the bored hole, to form the crushing/shredding machine; and (h) providing a means for connecting the crushing/shredding machine into a flow line.

In yet another embodiment, the invention is directed to a crushing/shredding machine having a stationary grid and a rotatable set of blades on a shaft prepared by a method which comprises the steps of:

(a) providing a first flange and a second flange, wherein the first flange has an open inner portion and the second flange has a grid inner portion of the same general shape as the open inner portion of the first flange, and wherein the grid inner portion has a number of parallel grid openings;

(b) providing an attachment means for attaching the first flange to the second flange in face-to-face relationship;

(c) attaching the first flange to the second flange in face-to-face relationship to form the stationary grid;

(d) boring a hole extending diametrically through the attached first and second flanges;

(e) detaching the first and second flanges;

(f) inserting a rotatable set of blades on a shaft axially through the bored hole, wherein the rotatable set of blades is adapted for rotation by an exterior power source, and each blade corresponds to a grid opening, and is positioned along the shaft within its grid opening; and (g) attaching the first flange to the second flange, with the rotatable set of blades on a shaft extending axially through the bored hole, to form the crushing/shredding machine; and (h) providing a means for connecting the crushing/shredding machine into a flow line.

DETAILED DESCRIPTION OF THE INVENTION

The present invention pertains to a new "sandwich" design for crushing or shredding machines that allows for high pressure pipeline applications, provides greater flexibility in the design of the crushing or shredding components, and is an inexpensive approach to construction. The body of the crushing or shredding machine is constructed from two flanges of plate metal, preferably two pieces of plate steel. Using computer aided machining techniques such as laser cutting or wire EDM, the two flanges are fabricated either to a standard shape or to a custom shape, as required by a particular application. The first flange has an open inner portion and the second flange has a grid inner portion of the same general shape as the open inner portion of the first flange. The grid inner portion can be of any known design in the art, such as a screen, to retain large particles in the crushing zone and to act as an impact surface as the rotating blade passes by. The two flanges or plates can then be machined or ground to a precision thickness, and then machined so that they can be attached, or bolted together. Once bolted together the two plates become a single body. Additional machining operations take place to allow for the rotary and stationary blades to be installed, and to insure that the two body plates can be unbolted and returned to their precise positions repeatedly. The advantage of this design is that the body of the machine can be unbolted, separated along its main axis, have a crushing or shredding mechanism installed, and then be bolted back together. The inlet to outlet dimension can be made uniquely short. The design greatly simplifies and economizes body construction, which allows an almost unlimited number of designs for rotary and stationary cutter or shredder designs, and also reduces the number of parts required for a complete system.

The invention will be better understood from the following detailed description of the preferred embodiments taken in conjunction with the Figures, in which like elements are represented by like referenced numerals.

FIG. 1 illustrates diagrammatic views of the different components of the crushing/shredding machine in a preferred embodiment of the present invention.

FIG. 1A is a front view of the first flange having an open inner portion of the stationary grid of the crushing/shredding machine. In FIG. 1A, the first flange is depicted generally as 100 and is constructed in accordance with a preferred embodiment of the present invention. Flange 100 may be made from plate metal such as plate steel and may be cut by any conventional technique from a one inch plate. Flange 100 contains a plate metal portion 101 and an open inner portion 102. The open inner portion 102 in this embodiment is of a generally round shape. Open inner portion 102 may be of any shape such as a round, oval, square, or rectangular shape, depending upon the particular application.

FIG. 1B is a front view of the second flange having a grid inner portion of the stationary grid of the crushing/shredding machine. In FIG. 1B, the second flange is depicted generally as 200 and is constructed in accordance with a preferred embodiment of the present invention. Flange 200 may be made from plate metal such as plate steel and may be cut by any conventional technique from a one inch plate. Flange 200 contains a plate metal portion 201 and a grid inner portion 202. Grid inner portion 202 has a number of parallel grid openings, the number and size of which will depend upon the particular application. The grid inner portion 202 of second flange 200 is of the same general shape as the open inner portion 102 of the first flange 100.

FIG. 1C is a top view of the first flange of the stationary grid of the crushing/shredding machine showing the thickness of the flange. In FIG. 1C, plate metal portion 101 of first flange 100 is ground on both sides to a desired thickness, such as about 0.938 inches for flatness.

FIG. 1D is a top view of the second flange of the stationary grid of the crushing/shredding machine showing the thickness of the flange. In FIG. 1D, plate metal portion 201 of second flange 200 is ground on both sides to a desired thickness, such as about 0.938 inches for flatness.

FIG. 1E is a front view of the stationary grid with the first flange attached to the second flange. In FIG. 1E, assembled stationary grid is depicted generally as 300 with first flange 100 bolted to second flange 200. First flange 100 and second flange 200 are attached, by an attachment means, in face-to-face relationship, such as by bolting them together. In FIG. 1A, six equally spaced holes 103 are drilled in the plate metal portion 101 of the first flange 100 of the stationary grid. In FIG. 1B, six equally spaced holes 203 are drilled in the plate metal portion 201 of the second flange 200 of the stationary grid. First flange 100 is bolted to second flange 200 by bolting the two flanges through holes 103 and 203, in face-to-face relationship, to provide assembled stationary grid 300 in FIG. 1E. Alternatively, first flange 100 may be superimposed upon second flange 200, and six equally spaced holes, 103 and 203, drilled in the plate metal portion 101 of first flange 100, and through plate metal portion 201 of second flange 200, of the stationary grid. First flange 100 is bolted to second flange 200 by bolting the two flanges through holes 103 and 203, in face-to-face relationship, to provide assembled stationary grid 300 in FIG. 1E.

In FIG. 1E, assembled stationary grid 300 is shown with second flange 200 (and grid inner portion 202) in the foreground and first flange 100 (and open inner portion 102) in the background. Assembled stationary grid 300 may be attached or bolted through any conventional means, such as with the use of cap screws 304, through holes 103 and 203. Once first flange 100 and second flange 200 are attached to form assembled stationary grid 300, hole 306 is bored diametrically through the attached first and second flanges, 100 and 200, of the assembled stationary grid 300 (through first plate metal portion 101 and first plate metal portion 201) at the seam where the flanges are bolted together.

FIG. 1F is a side view of the assembled stationary grid 300 with the first flange 100 attached to the second flange 200 showing a bore 306 extending diametrically through the attached first 100 and second 200 flanges at the seam where the flanges are attached. Assembled stationary grid 300 is now detached, or unbolted, to release first flange 100 and second flange 200.

FIG. 2 illustrates diagrammatic views of the different components of the crushing/shredding machine in a preferred embodiment of the present invention. FIG. 2A is a front view of a rotatable set of blades on a shaft 400.

FIG. 2B is a front cross sectional view of the assembled crushing/shredding machine with the rotatable set of blades on a shaft extending axially through a bore. In FIG. 2B, rotatable set of blades on a shaft 400 is inserted axially in the bored hole 306 extending diametrically through the attached first 100 and second flanges 200 of the assembled stationary grid 300 (FIG. 2B is a front cross section showing only second flange 200). The rotatable set of blades on a shaft 400 is adapted for rotation by an exterior power source (not shown). Each blade corresponds to a grid opening, and is positioned along the shaft within its grid opening. The first flange 100 is then reattached, or rebolted, to the second flange 200, with the rotatable set of blades on a shaft 400 extending axially through the bored hole 306, to form the crushing/shredding machine.

FIG. 2C is a top view of the assembled crushing/shredding machine 300 showing first flange 100 attached to the second flange 200, with the rotatable set of blades on a shaft 400 extending axially through the bored hole 306, to form the crushing/shredding machine.

Assembled stationary grid 300 is also provided with a means for connecting the grid into a flow line. In FIG. 1E, eight equally spaced holes 205 and 105 may be drilled in assembled stationary grid 300 of the crushing/shredding machine (through first plate metal portion 101 and through second first plate metal portion 201). Holes 205 and 105 are employed for bolting the final assembled crushing/shredding machine into the flow line of a pipeline. Alternatively, the eight equally spaced holes 205 and 105 may be drilled individually through the first plate metal portion 101 in FIG. 1A and second first plate metal portion 201 in FIG. 1B, prior to assembling stationary grid 300. Alternatively, the eight equally spaced holes 205 and 105 may be drilled in assembled stationary grid 300 as the last step after the rotatable set of blades on a shaft is inserted in FIG. 2B.

The invention being thus described, it will be obvious that the same may be varied in many ways. Such variations are not to be regarded as a departure from the spirit and scope of the invention and all such modifications are intended to be included within the scope of the following claims.

I claim:

1. A crushing/shredding machine which comprises:

(a) a stationary grid, adapted for connection into a flow line, having a first flange and a second flange, and an attachment means attaching the first flange to the second flange in face-to-face relationship, wherein:
  (i) the first flange has an open inner portion;
  (ii) the second flange has a grid inner portion of the same general shape as the open inner portion of the first flange, and wherein the grid inner portion has a number of parallel grid openings; and
  (iii) the attached first and second flanges have a bore extending diametrically through the attached first and second flanges; and (b) a rotatable set of blades on a shaft extending axially through the bore, and adapted for rotation by an exterior power source, each blade corresponding to a grid opening, and positioned along the shaft within its grid opening.

2. A crushing/shredding machine having a stationary grid and a rotatable set of blades on a shaft prepared by a method which comprises the steps of:

(a) providing a first flange and a second flange, wherein the first flange has an open inner portion and the second flange has a grid inner portion of the same general shape as the open inner portion of the first flange, and wherein the grid inner portion has a number of parallel grid openings;

(b) providing an attachment means for attaching the first flange to the second flange in face-to-face relationship;

(c) attaching the first flange to the second flange in face-to-face relationship to form the stationary grid;

(d) boring a hole extending diametrically through the attached first and second flanges;

(e) detaching the first and second flanges;

(f) inserting a rotatable set of blades on a shaft axially through the bored hole, wherein the rotatable set of blades is adapted for rotation by an exterior power source, and each blade corresponds to a grid opening, and is positioned along the shaft within its grid opening; and (g) attaching the first flange to the second flange, with the rotatable set of blades on a shaft extending axially through the bored hole, to form the crushing/shredding machine; and (h) providing a means for connecting the crushing/shredding machine into a flow line.

* * * * *